US008495775B2

(12) United States Patent
Fair et al.

(10) Patent No.: US 8,495,775 B2
(45) Date of Patent: Jul. 30, 2013

(54) TRAVEL NURSING PILLOW

(75) Inventors: Paul Fair, Denver, CO (US); Jamie Kummerfeld, Wheat Ridge, CO (US)

(73) Assignee: The Boppy Company, LLC, Golden, CO (US)

( * ) Notice: Subject to any disclaimer, the term of this patent is extended or adjusted under 35 U.S.C. 154(b) by 165 days.

(21) Appl. No.: 13/071,358

(22) Filed: Mar. 24, 2011

(65) Prior Publication Data

US 2012/0240339 A1 Sep. 27, 2012

(51) Int. Cl.
*B68G 5/00* (2006.01)

(52) U.S. Cl.
USPC ..... 5/655; 5/652; 5/657

(58) Field of Classification Search
USPC ..... 5/655, 652, 657, 639, 485, 636; 383/4
See application file for complete search history.

(56) References Cited

U.S. PATENT DOCUMENTS

| | | | |
|---|---|---|---|
| 4,731,890 | A | 3/1988 | Roberts |
| D315,845 | S | 4/1991 | Lafley |
| D318,202 | S | 7/1991 | Weber |
| D318,969 | S | 8/1991 | Byrn |
| 5,092,005 | A | 3/1992 | Byrn |
| 5,109,557 | A | 5/1992 | Koy et al. |
| 5,154,649 | A | 10/1992 | Pender |
| 5,261,134 | A | 11/1993 | Matthews |
| 5,519,906 | A | 5/1996 | Fanto-Chan |
| 5,546,620 | A | 8/1996 | Matthews |
| 5,551,109 | A | 9/1996 | Tingley et al. |
| 5,581,833 | A | 12/1996 | Zenoff |
| 5,661,861 | A | 9/1997 | Matthews |
| 5,790,999 | A | 8/1998 | Clark |
| 6,038,720 | A | 3/2000 | Matthews et al. |
| 6,055,687 | A | 5/2000 | Matthews |
| 6,061,854 | A | 5/2000 | Crowley |
| 6,189,169 | B1 | 2/2001 | Marcotte |
| D443,461 | S | 6/2001 | Hall et al. |
| D444,981 | S | 7/2001 | Hall et al. |
| 6,279,185 | B1 | 8/2001 | Matthews |

(Continued)

FOREIGN PATENT DOCUMENTS

GB 2 198 341 A 6/1988

OTHER PUBLICATIONS

Author Unknown, "Baby Hobo How it Works," Warm Milk, http://www.warmmilk.com/babyhobo.html, accessed May 5, 2011, 2 pages.

(Continued)

*Primary Examiner* — Peter M Cuomo
*Assistant Examiner* — Brittany Wilson
(74) *Attorney, Agent, or Firm* — Kilpatrick Townsend & Stockton LLP

(57) ABSTRACT

A support pillow includes a pillow body having a medial region and two curved arms that extend from the medial region. The pillow body has a curved exterior periphery and an interior periphery that defines a well when the pillow is in an open position. A first flap portion extends from the exterior periphery of a first one of the curved arms and a second flap portion extends from the exterior periphery of a second one of the curved arms. A fastening mechanism is configured to couple the first and the second flap portions to each other when the pillow body is folded in half to place the pillow in a closed position, with the first and the second arms being generally adjacent to each other.

22 Claims, 10 Drawing Sheets

U.S. PATENT DOCUMENTS

| | | | |
|---|---|---|---|
| 6,321,403 | B1 | 11/2001 | Matthews |
| 6,381,786 | B1 | 5/2002 | Cadden |
| 6,412,128 | B1 | 7/2002 | Matthews |
| 6,434,770 | B2 | 8/2002 | Matthews Brown |
| 6,453,493 | B1 | 9/2002 | Matthews Brown |
| 6,484,337 | B1 | 11/2002 | Moe et al. |
| 6,532,612 | B2 | 3/2003 | Matthews Brown |
| 6,553,590 | B1 | 4/2003 | Leach |
| 6,564,408 | B2 | 5/2003 | Van Vuuren |
| 6,625,828 | B2 | 9/2003 | Matthews Brown |
| 6,640,977 | B2 | 11/2003 | Matthews Brown et al. |
| 6,651,282 | B1 | 11/2003 | Skoug et al. |
| 6,658,681 | B2 | 12/2003 | Britto et al. |
| 6,671,908 | B2 | 1/2004 | Brown et al. |
| 6,685,024 | B1 | 2/2004 | Matthews |
| 6,708,354 | B1 | 3/2004 | Carter et al. |
| 6,711,770 | B1 | 3/2004 | Owens et al. |
| 6,754,924 | B1 | 6/2004 | Brady et al. |
| 6,763,539 | B1 | 7/2004 | Bartley et al. |
| 6,842,925 | B1 | 1/2005 | Owens et al. |
| 6,851,143 | B2 | 2/2005 | Matthews Brown |
| 6,857,150 | B2 | 2/2005 | Matthews Brown et al. |
| D503,062 | S | 3/2005 | Nash |
| 6,918,148 | B2 | 7/2005 | Auxila |
| 6,944,898 | B2 | 9/2005 | Matthews Brown et al. |
| 7,000,274 | B2 | 2/2006 | Matthews Brown et al. |
| 7,000,275 | B2 | 2/2006 | Matthews Brown et al. |
| 7,000,766 | B2 | 2/2006 | Matthews Brown et al. |
| 7,010,821 | B1 | 3/2006 | Leach |
| 7,017,212 | B2 | 3/2006 | Matthews Brown |
| 7,055,196 | B2 | 6/2006 | Littlehorn |
| 7,089,639 | B2 | 8/2006 | Matthews Brown et al. |
| 7,111,347 | B1 | 9/2006 | Cottrell |
| 7,127,760 | B2 | 10/2006 | Bartley et al. |
| 7,131,156 | B1 | 11/2006 | Walker-Craft |
| 7,146,663 | B2 | 12/2006 | Brown et al. |
| 7,290,303 | B2 | 11/2007 | Mead et al. |
| 7,322,061 | B2 | 1/2008 | Carroll |
| 7,331,073 | B2 | 2/2008 | Littlehorn et al. |
| D567,562 | S | 4/2008 | Nash |
| D571,596 | S | 6/2008 | Alvistur et al. |
| 7,386,902 | B2 | 6/2008 | Wilson |
| 7,404,222 | B2 | 7/2008 | Tidwell |
| D578,818 | S | 10/2008 | Margalit |
| D579,256 | S | 10/2008 | Alfieri et al. |
| 7,430,774 | B2 | 10/2008 | Littlehorn et al. |
| 7,451,508 | B2 | 11/2008 | Matthews Brown et al. |
| 7,464,423 | B2 * | 12/2008 | Goodwin et al. ..... 5/655 |
| 7,472,443 | B2 | 1/2009 | Littlehorn et al. |
| 7,513,001 | B1 | 4/2009 | Leach |
| D593,787 | S | 6/2009 | Dafna |
| 7,540,049 | B2 | 6/2009 | Sklenarik et al. |
| 7,562,406 | B1 | 7/2009 | Leach |
| 7,587,773 | B2 | 9/2009 | Littlehorn et al. |
| 7,624,461 | B2 | 12/2009 | Tidwell et al. |
| 7,657,955 | B1 * | 2/2010 | Alvistur et al. ..... 5/655 |
| 7,703,159 | B2 | 4/2010 | Parrilla |
| 7,752,692 | B1 | 7/2010 | Sanders et al. |
| 7,788,752 | B2 | 9/2010 | Tidwell et al. |
| 7,810,191 | B2 | 10/2010 | Littlehorn et al. |
| 7,832,036 | B2 | 11/2010 | Littlehorn et al. |
| 7,886,381 | B2 | 2/2011 | Aiken et al. |
| 2005/0173962 | A1 | 8/2005 | Stein et al. |
| 2008/0010750 | A1 | 1/2008 | Tidwell |
| 2011/0023236 | A1 | 2/2011 | Sanders et al. |

OTHER PUBLICATIONS

Author Unknown, "Home Page," Peek Away, http://www.peekaway.com/Home.html, accessed May 5, 2011, 4 pages.

Author Unknown, "Stylish Nursing Cover and Nursing Pillow All-In-One," Belly Fish, http://www.belly-fish.com/, accessed May 5, 2011, 2 pages.

Author Unknown, "Travel Pillow," My Brest Friend, http://www.mybrestfriend.com/products/travel-pillow, accessed May 5, 2011, 2 pages.

Author Unknown, "Welcome to Simply Necessary, Incorporated," Simply Necessary Incorporated, http://www.simplynecessary.com/, accessed May 5, 2011, 1 page.

International Search Report and Written Opinion of PCT/IB2012/000589 mailed on Jul. 11, 2012, 8 pages.

* cited by examiner

TRAVEL NURSING PILLOW

BACKGROUND OF THE INVENTION

This invention relates generally to the field of pillows, and in particular to pillows that can be easily be manipulated into certain arrangements for convenient travel or storage.

Over the years, a variety of support pillows have found commercial acceptance. Once exemplary support pillow is the Boppy® pillow, marketed by The Boppy Company. Various forms of this pillow are described in U.S. Pat. Nos. 5,261,134, 5,546,620, 5,661,861, and 6,055,657, among others. The complete disclosures of these patents are incorporated herein by reference.

One need for such pillows is the ability to conveniently store and transport them. In particular, it would be desirable to prove easy ways to reduce the overall size of such pillows and to provide an easy way to carry them over longer distances.

BRIEF SUMMARY OF THE INVENTION

One embodiment of the invention provides an exemplary infant feeding and support pillow that comprises a pillow body having a medial region and two curved arms that extend from the medial region. The pillow body has a curved exterior periphery and an interior periphery that defines a well when the pillow is in an open position. A first flap portion extends from the exterior periphery of a first one of the curved arms and a second flap portion extends from the exterior periphery of a second one of the curved arms. A fastening mechanism is configured to couple the first and the second flap portions to each other when the pillow body is folded in half to place the pillow in a closed position, with the first and the second arms being generally adjacent to each other. Coupling of the arms together while in the folded position helps to reduce the overall bulk of the pillow during transport or storage.

In one aspect, the pillow body has a centerline bisecting the medial region and the well. In this way, the first and the second arms are placed against each other when the pillow body is folded along the centerline. Placing the arms adjacent each other during travel and storage helps to keep clean the fabric upon which the infant is typically placed.

In another aspect, the flaps each contain a transition region extending from the pillow body, and a shoulder strap is coupled to the transition regions. A fastener, such as a buckle removably couples one of the transition regions to the shoulder strap. The pillow may then be carried by placing the shoulder strap over a person's shoulder.

In a further aspect, a cover is coupled to one of the arms. The cover is extendable over the well and may be coupled to the other arm when the pillow is in the open position or may be folded back on itself to expose the well when the pillow is in the open position. Further, the cover forms a top surface when the cover extends over the well and the pillow is placed in the closed position. In some cases, the cover includes a pocket and a pocket fastener to hold the pocket closed.

In one arrangement, a pouch is coupled to the medial region of the pillow body. This pouch may be used to hold one of the transition regions, as well as the shoulder strap when the pillow is in the open position. The pouch may include a fastener, such as a piece of hook and loop fabric or snap to hold the pouch closed.

In yet another aspect, a fastener is coupled to each transition region to permit the pillow to be coupled to a stroller or other object.

The invention further comprises an exemplary method for configuring a pillow. The method utilizes a pillow comprising a pillow body having a medial region and two curved arms that extend from the medial region. The pillow body has a curved exterior periphery, an interior periphery, a first flap portion extending from the exterior periphery of a first one of the curved arms, a second flap portion extending from the exterior periphery of a second one of the curved arms, and a fastening mechanism. The pillow is placed in an open position where the inner periphery forms a well. The pillow body is folded in half to place the pillow in a closed position where the first and the second arms are generally adjacent each other. The first and the second flap portions are fastened to each other using the fastening mechanism when the pillow body is in the closed position.

In one aspect of the method, the flaps each contain a transition region extending from the pillow body, and a shoulder strap is coupled to one of the transition regions. A free end of the shoulder strap may be coupled to the other transition using a buckle.

In another aspect, a cover is coupled to one of the arms and may be used in a variety of ways. For example, the cover may be extended over the well and coupled to the other arm when the pillow is in the open position. With this arrangement, the pillow body may be placed on a surface such that the cover contacts the surface, and a baby may be placed within the well and on top of the cover. As another example, the cover may be folded back on itself to fully expose the well when the pillow is in the open position. With this configuration, the pillow may be placed about the waist of a user, and a baby or other object may be positioned on the medial region. For instance, a mother may nurse a baby while the baby rests on the pillow. Also, the flaps may be folded down so as to not interfere with the baby's comfort.

In another aspect, the cover includes a pocket that may be opened to place an object into the pocket when the pillow is in the closed position. The pillow may also include a pouch that is coupled to the medial region of the pillow body. In one step of the method, one of the transition regions is placed in the pouch when the pillow is in the open position.

In some cases, one or more fasteners may be provided to permit the pillow to be attached to other objects, such as to the back of a stroller.

DETAILED DESCRIPTION OF THE INVENTION

Figure 1:
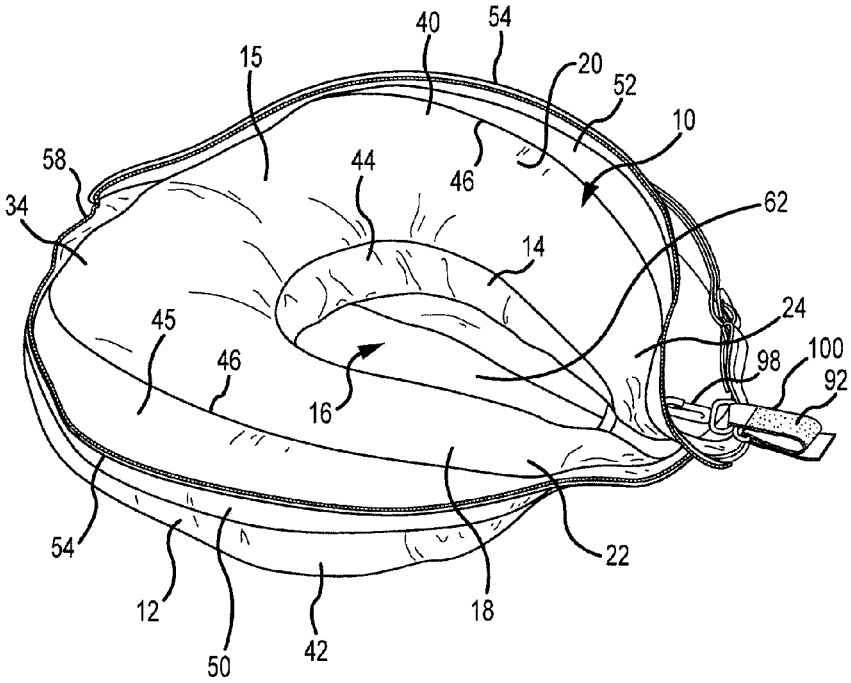
FIG. 1 illustrates a top perspective view of one embodiment of a travel pillow in an open position according to the invention.

The invention provides various infant feeding and support pillows that may be conveniently configured and arranged for travel or storage. In this way, the pillows can be used in their normal configuration, then easily be collapsed and secured for travel or storage. For example, the pillows are normally in a configuration that permits them to be used in supporting a baby, as well as for adult uses, such as assisting a mother in nursing. When the pillows need to be transported or stored, the pillows may be transformed from an open position to a closed position where the pillow is reduced in overall size and bulk. For instance, the pillows may take the form of a purse or tote bag that can be carried on a user's shoulder or attached to another object, such as a stroller or wheeled vehicle.

The pillows may be constructed of a medial region and two opposing arms that may be widely separated from each other without damaging or permanently distorting the pillow. When the arms are released, they spring back to their original position. This permits the pillow to be placed about large objects, with the arms tensioned against the object, yet not uncomfortably. For example, when the ends of the pillow arms are separated enough to be placed about the torso of an average sized adult, the inward force produced by each arm is sufficient to hold the pillow in place about the torso, yet not so tight that it is uncomfortable. Further, when the pillow clings about a relatively large object, the medial region does not buckle, but keeps its shape. When removed, the pillow's resilience permits it to spring back to its original shape, typically with the ends being separated by about 8 inches or less, and in some cases about 4 inches or less and in other cases about 2 inches or less.

To construct the pillow, a cover or shell is used to surround a fill material. In some cases, the cover may include a central panel surrounding the well. The fill material used to make the pillow may be such that the pillow is relatively firm when filled, particularly so that the pillow will not significantly deflect under the weight of a baby. Examples of materials that may be used include polyester fibers, foamed materials, and the like. One method for filling the cover with a fill material is described in U.S. Pat. No. 7,089,639, which is incorporated herein by reference.

The cover may be constructed of a main portion using one or more pieces of fabric and a center panel at the inner periphery of the pillow. The overall shape of the pillow may be similar to those described in U.S. Pat. Nos. 5,261,134, 5,661,861, 5,546,620 and 6,055,687; 6,685,024; 6,434,770; 6,671,908; 7,017,212; 6,279,185; 6,412,128; 7,451,508; 7,127,760; 6,944,898; 7,587,773; 7,472,443; and 7,404,222, incorporated herein by reference. The main portion of the cover or shell may, in some cases, be constructed of two or more pieces of material which are sewn to each other, with the center panel being sewn to the main portion, although other coupling techniques may be used, such as by using a fabric glue. Some techniques for attaching a center panel of material to a cover is also described in U.S. Pat. No. 6,412,128 and U.S. Patent Publication No. 2008/0010750, which are incorporated herein by reference. The material used to construct the main portion of the cover and/or the center panel may be a fabric, such as cotton, polyester, velvet, chiffon and the like. Such fabrics permit the pillow to be firmly stuffed with fill materials. When stuffed in this manner, the pillows are able to maintain their shape for extended time periods. Such fabrics also provide an aesthetically pleasing surface.

The support pillows of the invention may find use with a variety of applications where the arms are manipulated to be placed around an object. Merely by way of example, such applications may include placement about a torso to facilitate nursing, the holding of an object, such as a book, a toy, food, or the like, to function as a back support, or the like. The support pillows of the invention may also find use with the applications described in U.S. Pat. Nos. 5,261,134, 5,661,861, 5,546,620 and 6,055,687; 6,685,024; 6,434,770; 6,671,908; 7,017,212; 6,279,185; 6,412,128; 7,451,508; 7,127,760; 6,944,898; 7,587,773; 7,472,443; and 7,404,222, previously incorporated herein by reference.

Figure 2:
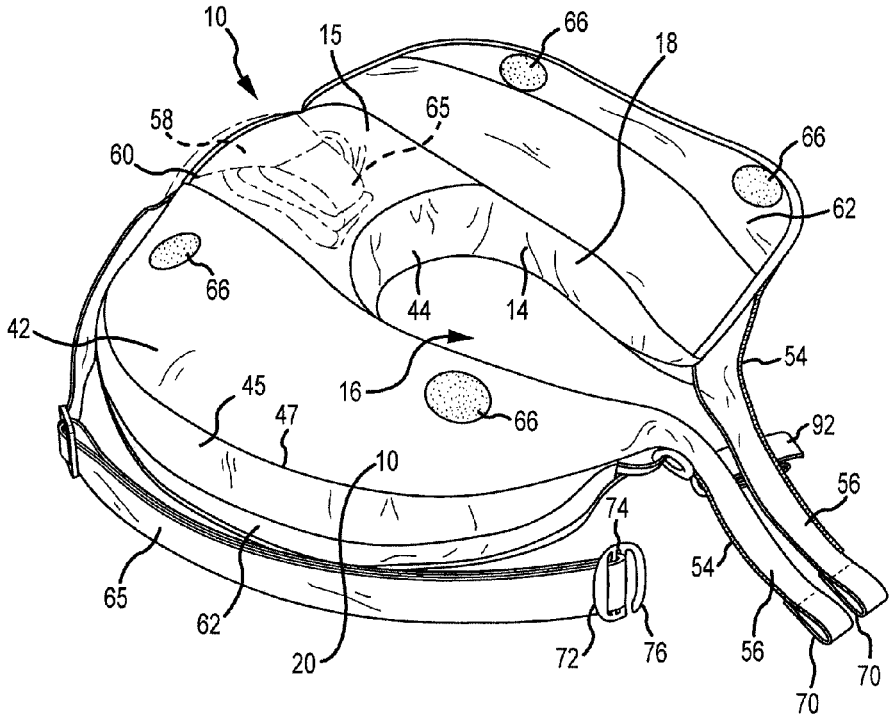
FIG. 2 is a bottom perspective view of the pillow of FIG. 1 showing a cover being folded back to expose a well.
Figure 3:
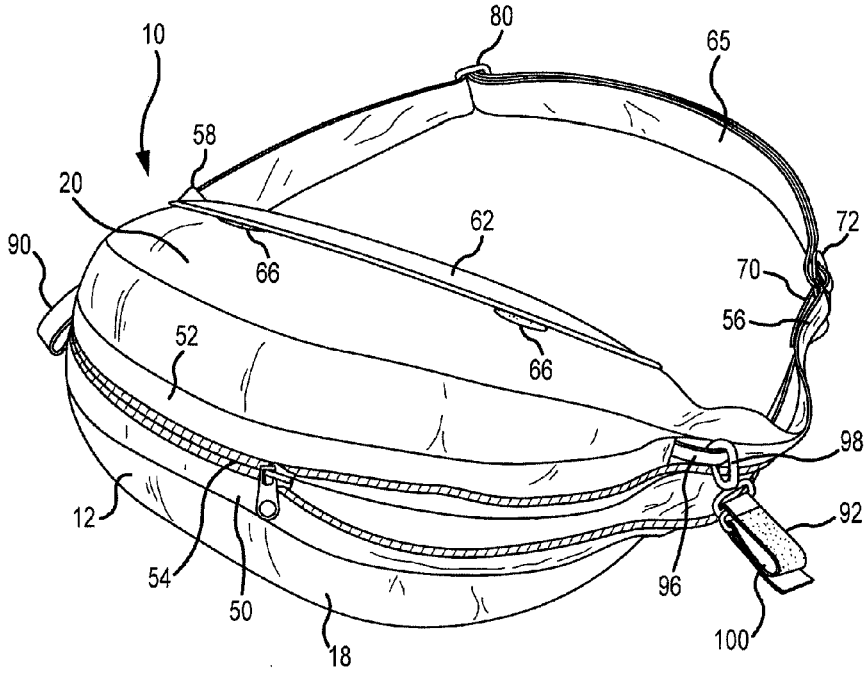
FIG. 3 is a bottom perspective view of the pillow of FIG. 1 when placed in a closed position suitable for traveling.

Referring now to FIGS. 1 and 2, one embodiment of an infant feeding and support pillow 10 will be described. Pillow 10 may be constructed to have an overall shape and feel that are similar to the support pillows described in U.S. Pat. Nos. 5,261,134, 5,661,861, 5,546,620 and 6,055,687; 6,685,024; 6,434,770; 6,671,908; 7,017,212; 6,279,185; 6,412,128; 7,451,508; 7,127,760; 6,944,898; 7,587,773; 7,472,443; and 7,404,222, previously incorporated herein by reference. However, the invention is not intended to be limited to only such support pillows, but may be used with essentially any type of pillow having two arms that may be separated from each other. Support pillow 10 includes a curved outer surface or periphery 12 which is rounded in both a longitudinal and a lateral direction to form an outer periphery. Support pillow 10 further includes a curved central inner surface or periphery 14 which defines a rounded, generally circular, curved or elliptical well region 16. While the body of the support pillow 10 is substantially continuous and uniform, with curved surfaces 12 and 14 also being continuous, it is convenient to consider the pillow body as having a medial region 15 and two opposing arms 18 and 20. The arms 18 and 20 extend in opposite directions away from the medial region 15, but are curved towards one another to give the pillow 10 its overall curved configuration. While the continuous structure does not provide a precise or exact division between the medial region 15 and each arm, considering the body of the pillow in view of these components facilitates a description of the structure and function of the pillow 10.

Arms 18 and 20 include respective ends 22 and 24, positioned remotely of the medial region 15. Support pillow 10 is proportioned so that ends 22 and 24 normally, i.e., when not under external stress, touch or are slightly separated from each another, typically within about 8 inches, usually within about 4 inches and in some cases within about 2 inches of each other. However, ends 22 and 24 do not exert substantial pressure against each other, if touching. Pillow 10 has a bilateral symmetry with respect to a central plane which passes vertically through medial region 15. Pillow 10 is also symmetrical about a mid-plane which horizontally bisects the pillow body. In some cases, it may be convenient to refer to a center line which horizontally lies along and bisects the pillow.

Well region 16 has a width that is selected to permit the support pillow to fit "snug" around the torso or waist of most users. The pillow 10 is also constructed so that the arms 18 and 20 may be moved away from each other to vary the width so that the pillow 10 may be used in a variety of applications, including larger sized adults.

Pillow 10 includes a central core which may be constructed of a fill material, such as a hypoallergenic polyester filling. The central core is encased by a cover 34. The majority of cover 34 is constructed of a material that is compliant while generally not stretchable. Examples of such fabrics include cotton, polyesters or other pliant conforming fabrics. The fill material is firmly and tightly packed into cover 34, such that the core and cover 34 together provide a self-supporting pillow body, i.e., the support pillow 10 retains its shape without any sagging or drooping of arms 18 and 20 when held at the medial region 15. The tightly packed fill material forming core also provides the pillow with firmness in the sense that it will undergo only slight elastic deformation (as compared to a conventional pillow) when an object (such as a persons' arms or elbows) is rested on the arms 18 and 20 or medial region 15. Other fill materials that could be used include natural or synthetic fibers, synthetic beads, feathers, foam, and organic granular fill materials such as husks and seeds and the like.

In the embodiments shown, cover 34 is formed of multiple pieces of fabric, it being appreciated that cover 34 could be constructed in other ways as well. For convenience of discussion, cover 34 can be described in terms of three major components: a top piece 40 (which forms a top surface), a bottom piece 42 (which forms a bottom surface), and a center panel 44. To facilitate the inclusion of coupling flaps (described hereinafter), an outer panel 45 (which in turn may be constructed from two ore more pieces of fabric) may be placed between top piece 40 and bottom piece 42 at the outer periphery 12. Outer panel 45 may be sewn between top piece 40 and bottom piece 42 to form seams 46 and 47 on opposites sides of the centerline, although in some cases top piece 40 and bottom piece 42 could be sewn together at the outer perimeter along the centerline. Examples of materials that may be used for top piece 40 and bottom piece 42 include cotton fabrics, polyester fabrics, cotton/poly blends and the like. By using such materials for the top piece 40 and bottom piece 42, various conventional fabrics may be used to provide a comfortable, decorative and aesthetically pleasing surface. Although shown with top piece 40 and bottom piece 42, it will be appreciated that a single piece of fabric or multiple pieces may be used to cover the top and bottom of the pillow. Sewn to top piece 40 and bottom piece 42 is center panel 44. In this way, center panel 44 surrounds the inner well 14 and eliminates a seam running along the mid-plane. Although the pieces may be sewn together, other techniques may also be used, such as by using glue, lacing, staples, snaps and the like. Center panel 44 permits arms 18 and 20 to be separated without tearing or bunching of the fabric that is adjacent the inner well 14. Further, the configuration the center panel 44 makes the pillow sufficiently resilient to spring arms 18 and 20 back to their original shape. Also, the center panel 44 is configured to provide a sufficient inward force on arms 18 and 20 so that they securely hold pillow 10 about an object, without being uncomfortable.

The configuration shown in FIGS. 1 and 2 is the configuration pillow 10 is placed when in use, and, for convenience of discussion, may be referred to as the open position. As will be described hereinafter, pillow 10 may be folded in half at medial region 15 such that arms 18 and 20 are positioned adjacent each other in a closed or travel position. To facilitate keeping pillow 10 in the closed position, flaps 50 and 52 extend from arms 18 and 20, respectively. Flaps 50 and 52 may comprise pieces of fabric that are sewn to cover 34, or could be extensions of the same fabric used to construct cover 34. In one embodiment, two pieces of fabric are used to construct outer panel 45, with flaps 50 and 52 being sewn into the seam formed between these two pieces of fabric. Flaps 50 and 52 may extend a distance from arms 18 and 20 that is in the range from about 0.5 inch to about 3 inches. Such a distance permits the flaps to be placed into contact with each other when the pillow 10 is placed in the closed position. A zipper 54 is coupled to each flap 50 and 52 so that when pillow 10 is placed in the closed position, zipper 54 may be zipped to secure arms 18 and 20 together. Although shown with a zipper, other fasteners could be used, such as a loop and hook fastener, buttons, snaps, ties, hooks and the like.

At ends 22 and 24, flaps 50 and 52 each include a separate transition region 56, while at medial region 15 flaps 50 and 52 combine to form a single transition region 58. In this way, zipper 54 may be zipped at transition region 58 to allow zipper 54 to be easily zipped closed when pillow 10 in placed in the closed position. Transition regions 56 and 58 are also used to transition from flaps 50 and 52 to a shoulder strap 65 as described hereinafter. To facilitate storage of transition region 58 and shoulder strap 65 when pillow 10 is in the open position, a pouch 60 may be included at medial region 15. Pouch 60 has an opening at outer periphery 12 to permit transition region 58 and shoulder strap 65 to be slipped into pouch 60 so that it does not interfere with the use of pillow 10. When the shoulder strap 65 is needed, transition region 58 and shoulder strap 65 can simply be slipped out from pouch 60. To facilitate construction of pouch 60, bottom piece 42 of cover 34 may be constructed of multiple pieces of fabric that are sewn together, with one piece being the approximate shape of pouch 60. In some cases, a fastener, such as a hook and loop fabric, snap or the like, may be used to close pouch 60.

Pillow 10 may also include a cover 62 that has the dual function of covering well 16 when pillow 10 is in the open position (as in the case shown in FIG. 1) as well as to cover arms 18 and 20 when pillow 10 is in the closed position. Additionally, as best shown in FIG. 2 cover 62 may be folded back on itself to expose well 16. In other words, cover 62 may be positioned across well 16 or else folded back so that well 16 is fully open. As an example, cover 62 could be placed over well 16 in cases where pillow 10 is placed on the floor so that cover 62 functions as a blanket when a baby is placed into well 16, thereby keeping the baby from coming into direct contact with the floor as well as to provide some padding. When cover 62 is not needed, such as when pillow 10 is placed about a user's waist, it may simply be removed from well 16. To keep cover 60 in place over well 16, fasteners 66 may be used. Fasteners 66 may comprise a hook and loop fastener material. However, other fasteners could be used, such as buttons, snaps, ties and the like.

Referring now to FIGS. 3-6, placement of pillow 10 into the closed or travel position will be described. To do so, pillow 10 may be folded about the mid-plane that bisects medial region 15 so that arms 18 and 20 are adjacent each other. Cover 62 is secured by fasteners 66 so as to cover arms 18 and 20 at the inner periphery 14. Also, zipper 54 is fastened to secure arms 18 and 20 at the outer periphery 12. In this way, the pillow body is enclosed by the cover in a compact configuration resembling a large purse or a tote bag. Use of zipper 54 permits compaction of pillow 10 to reduce its overall bulk. By positioning the arms 18 and 20 adjacent each other in this manner helps to keep the fabric forming top piece 40 clean during transport and storage. In this way, when pillow 10 is once again placed in the open position, top piece 40 is still clean and sanitary. When wrapped about arms 18 and 20, cover 62 also helps serve to keep dirt or contaminants from coming into contact with top piece 40. Further, the surface of cover 62 that normally comes into contact with the baby (such as when cover 62 is positioned over well 16 and a baby is sitting within the well 16) is wrapped around arms 18 and 20 and is also protected from dirt or contaminants when pillow 10 is in the closed position. Reduce bulk using zipper 54.

Figure 4:
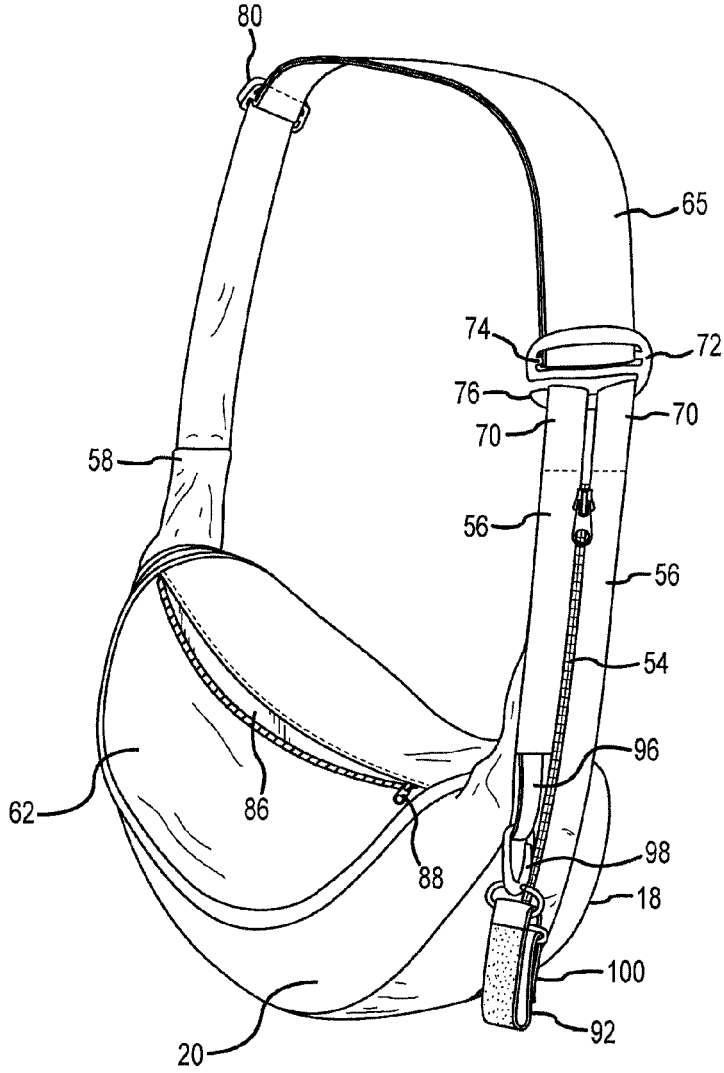
FIG. 4 is a top perspective view of the pillow of FIG. 3
Figure 5:
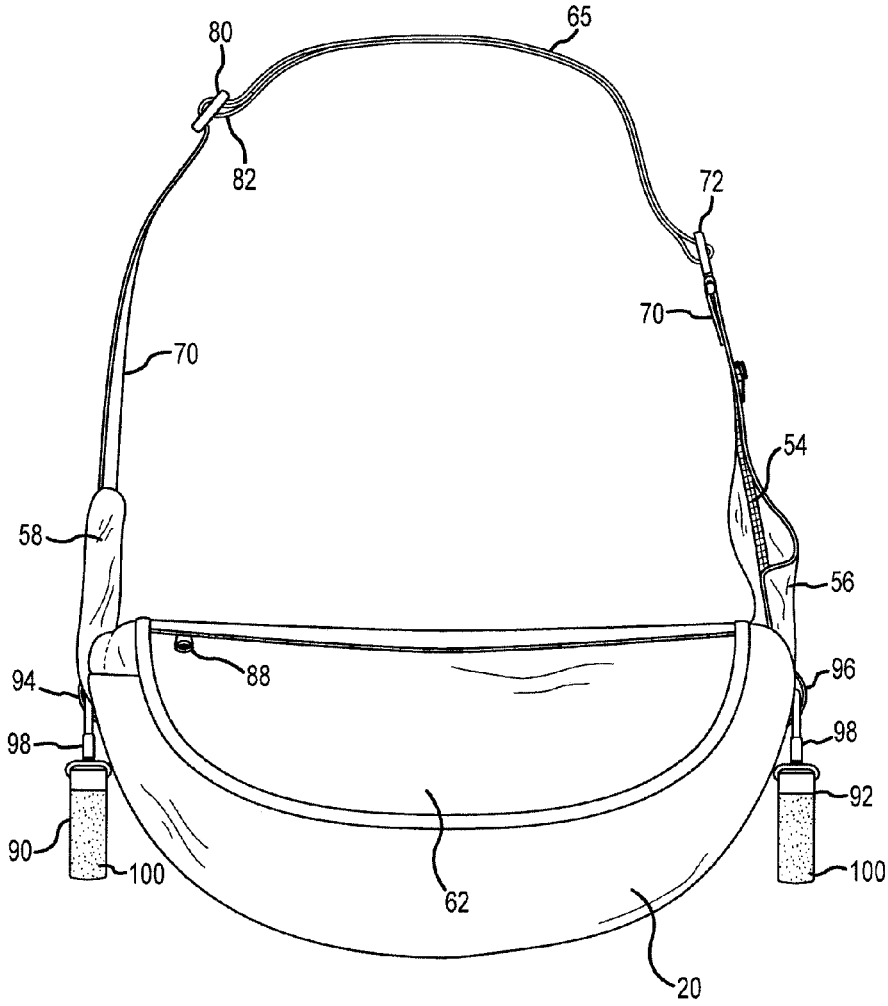
FIG. 5 is a front view of the pillow of FIG. 3.
Figure 6:
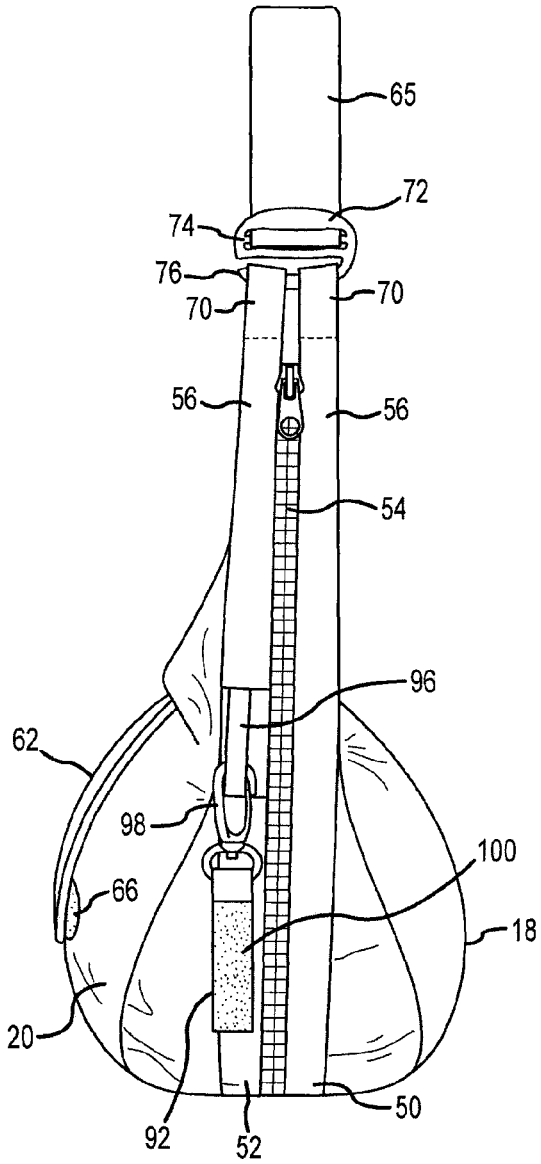
FIG. 6 is an end view of the pillow of FIG. 3.

Transition region 58 terminates at the end of zipper 54 where transition region 58 is sewn to shoulder strap 65. Transition region 56 extends beyond the other end of zipper 54 and includes loops 70 to permit transition region 56 to be coupled to the other end of shoulder strap 65. To do so, a buckle 72 may be used. Buckle 72 comprises a slide portion 74 and an arm 76. Slide portion 74 has one opening that receives one end of shoulder strap 65, which is looped around a slide bar and into the other opening as best shown in FIGS. 4-6. This provides an easy way to adjust the length of strap 65 as described below. Arm 76 is configured to receive loops 70 of transition region 56. In this way, shoulder strap 65 can easily be coupled to transition region 56 simply by slipping the loops 70 over arm 76. Also, arm 76 is curved to help prevent transition region 56 from prematurely disengaging from buckle 72. Optionally, arm 76 could include teeth or a gripping edge to help prevent premature disengagement of transition region 56 from buckle 72. Although described using buckle 72, it will be appreciated that other fasteners could be used, such as snaps, hook and loop fastener materials, clips, hooks, D rings, side release buckles and the like.

To assist with adjusting the length of shoulder strap 65, a slider adjuster 80 may also be used. The free end of shoulder strap 65 includes a loop 82 (see FIG. 5) that is placed around the slide bar of slider adjuster 80. For example, the end of shoulder strap 65 may be looped around the slide bar and sewn back onto itself. Shoulder strap 65 is also placed through both openings on opposites sides of the slide bar so as to pass on top of loop 82. Because shoulder strap 65 is looped around both slider adjuster 80 and the slide bar of slide portion 74, its length can be adjusted simply by moving slider adjuster 80 relative to buckle 72.

As best shown in FIG. 4, cover 62 may optionally include a pocket 86 that may be accessed by operating a zipper 88 or other fastening mechanism. When fully opened, the opening to pocket 86 extends the length of cover 62 to provide a wide pocket that can easily be accessed. Pocket 86 may be accessed both when pillow 10 is in the open or the closed position. In some cases, pocket 86 could be made smaller. In other cases, multiple pockets could be used, such as by including vertical sew lines to separate pocket 86 into multiple pockets, or by making horizontally spaced apart pockets.

Pillow 10 may optionally also include fasteners 90 and 92 that permit pillow 10 to be coupled to some other object, such as a chair, stroller, other wheeled vehicle, counter or the like. Transition region 58 may include a fabric loop 94 while transition region 54 may include a fabric loop 96 that permits fasteners 90 and 92, respectively, to be easily clipped to the pillow 10. For example, fasteners 90 and 92 may each include a clip 98 that is connected to a looped hook and loop fastener material 100 that in turn may be used to secure pillow 10 to another object. While both fasteners 90 and 92 may be used at the same time, such as, for example, when coupling the pillow 10 to the handle of a stroller, in some cases, only one will be needed. If fasteners 90 and 92 are not needed, they may simply be unclipped from loops 94 and 96.

Figure 7:
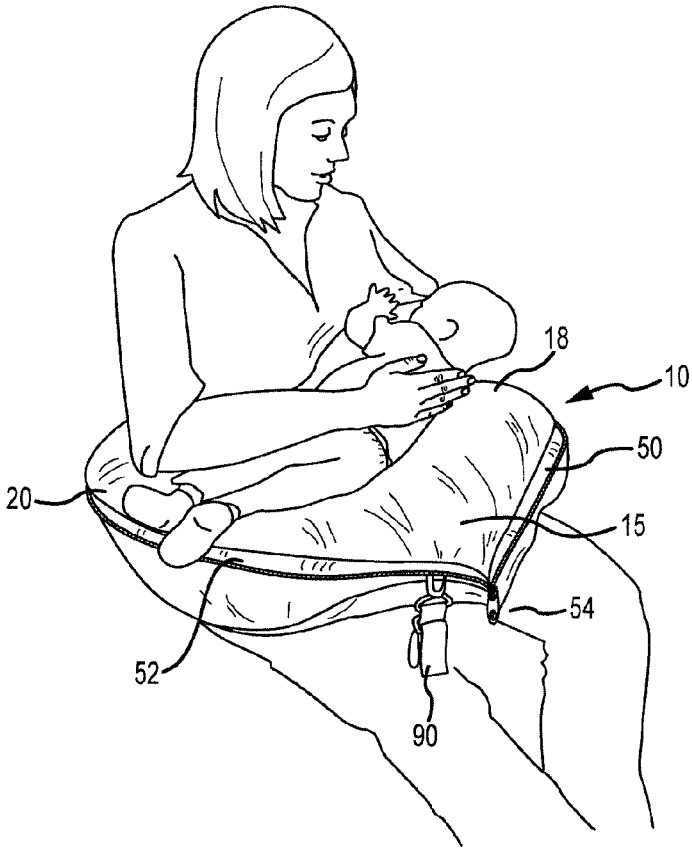
FIG. 7 illustrates the pillow of FIG. 2 when used in nursing a baby.

FIG. 7 illustrates one use of pillow 10 to facilitate nursing of a baby. To do so, pillow 10 is placed in the open configuration and arms 18 and 20 are slipped about the mother's waist, with medial region 15 being placed adjacent the mother's stomach. Also, flaps 50 and 52 are folded downward so as to not interfere with the baby positioned on the pillow. Shoulder strap 65 can also be loosened from buckle 72 and placed into pouch 60 as previously described. As also previously described, cover 62 can be unfastened from fasteners 66 and folded back so as to expose well 16. In this way, cover 62 will simply rest on one of the mother's legs. The baby may be position on the pillow 10, partly resting on arms 18 and 20 and medial region 15.

Figure 8:
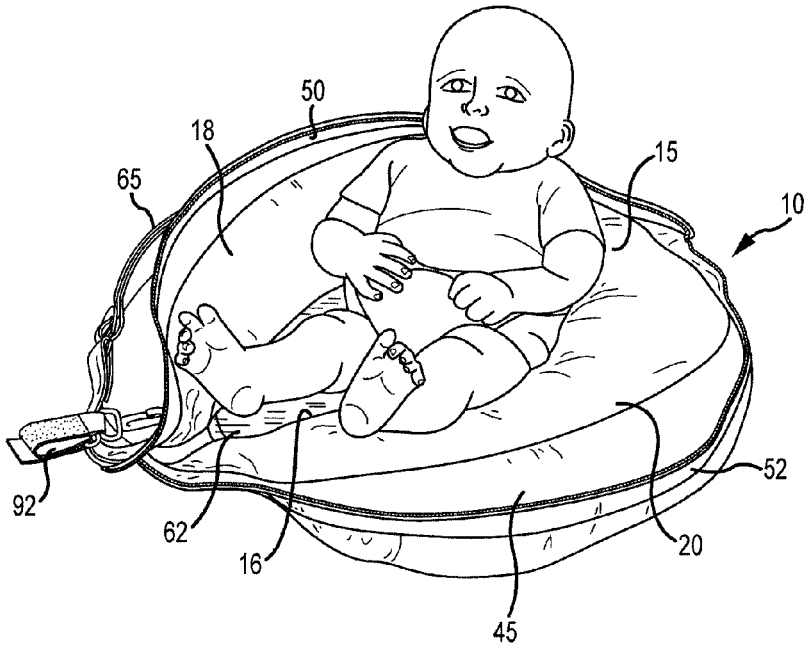
FIG. 8 illustrates the pillow of FIG. 1 when supporting a baby on a support surface.

FIG. 8 illustrates pillow 10 when used to support a baby. As shown, pillow 10 is in the open configuration. Also, cover 62 is positioned across well 16. Shoulder strap 65 may be placed in pouch 60 or could remain assembled. Also, flaps 50 and 52 could be folded downward similar to FIG. 7. In this way, the baby can rest upon cover 62 so as to not be exposed directly to the ground or other support surface. This provides a sanitary surface as well as providing a comfortable sitting area. Also, while the baby is shown in a sitting position, other positions may also be used, so as by having the baby in the supine position, with the baby's chest resting on medial region 15.

Figure 9:
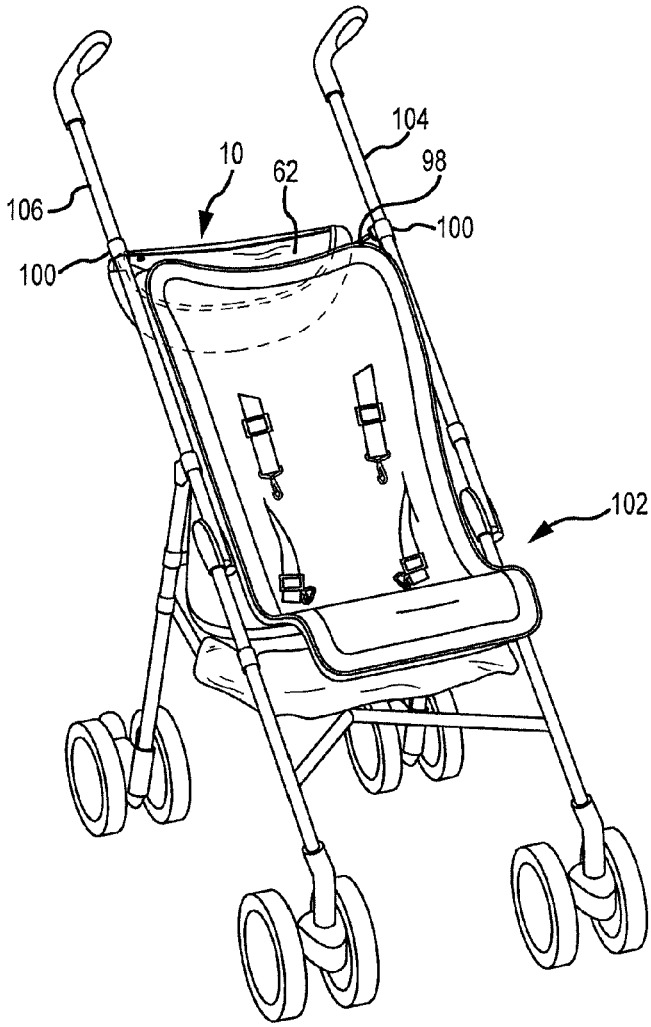
FIG. 9 illustrates the pillow of FIG. 4 when attached to a stroller.

FIG. 9 illustrates pillow 10 when in the closed position so that is may be coupled to a stroller 102 having a set of handle bars 104 and 106. To do so, hook and loop fastener material for fasteners 90 and 92 are looped about handle bars 104 and 106 and secured together. Removal may be accomplished by undoing the hook and loop fastener material 100 or unclipping clips 96 and 98.

Figure 10:
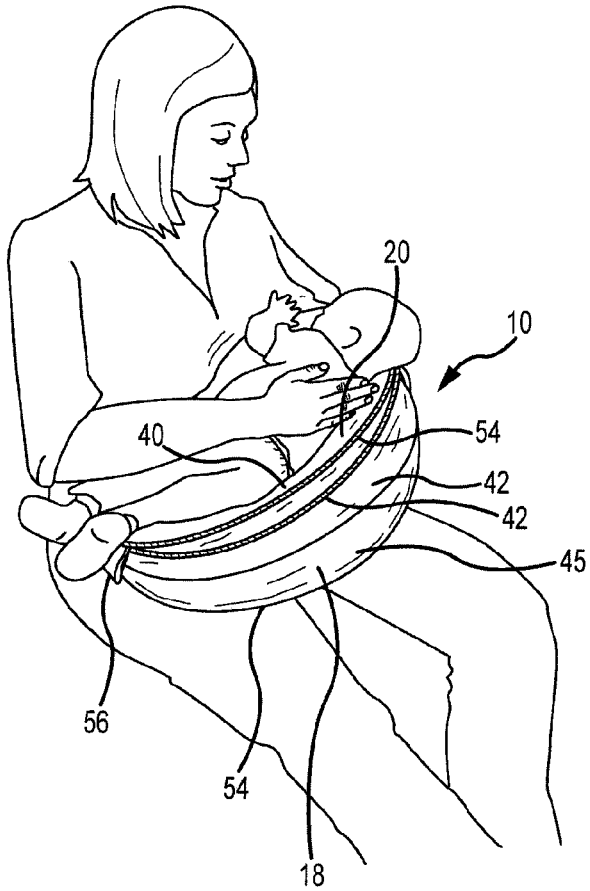
FIG. 10 illustrates the pillow of FIG. 1 when folded back on itself to assist in supporting a baby.

FIG. 10 illustrates an arrangement of pillow 10 that assists in elevating a baby while the baby is being held by a caregiver. In the arrangement of FIG. 10, pillow 10 is folded in half about medial region 15. However, unlike when in the closed position of FIGS. 3-6, arms 18 and 20 are folded in the opposite direction so that top piece 40 (which is typically kept clean and sanitary) is exposed and bottom piece 42 is folded back on itself. As shown, arm 18 is placed on the user's lap while arm 20 supports a baby. However, arm 20 could also be placed in the user's lap, with arm 18 contacting the baby. In the configuration shown in FIG. 10, the effective height of pillow 10 is doubled to assist in supporting the baby. This position can be particularly useful when nursing. If needed, shoulder strap 65 could be used to help hold pillow 10 about the user's waist.

The invention has now been described in detail for purposes of clarity and understanding. However, it will be appreciated that certain changes and modifications may be practiced within the scope of the appended claims.

What is claimed is:

1. An infant feeding and support pillow, comprising:

a pillow body comprising a medial region and two curved arms that extend from the medial region, wherein the pillow body has a curved exterior periphery and an interior periphery that defines a well when the pillow is in an open position;

a first flap portion extending from the exterior periphery of a first one of the curved arms and a second flap portion extending from the exterior periphery of a second one of the curved arms, wherein the arms are configured so as to be separable from each other to permit the arms to be placed about the waist of a user, with the medial region being adjacent the user's stomach and the arms being adjacent the user's sides, and wherein the arms and medial region are sized to permit a baby to be entirely supported by the medial region and the arms when the pillow is placed about the user's waist and the baby is resting on the medial region and the arms; and a fastening mechanism that is configured to couple the first and the second flap portions to each other when the pillow body is folded in half to place the pillow in a closed position, with the first and the second arms being generally adjacent to each other.

2. A pillow as in claim 1, wherein the pillow body has a centerline bisecting the medial region and the well, and wherein the first and the second arms are placed against each other when the pillow body is folded along the centerline.

3. A pillow as in claim 1, wherein the flaps each contain a transition region extending from the pillow body, and further comprising a shoulder strap coupled to the transition regions.

4. A pillow as in claim 3, further comprising a fastener that removably couples one of the transition regions to the shoulder strap.

5. A pillow as in claim 1, further comprising a cover coupled to one of the arms, wherein the cover is extendable over the well and may be coupled to the other arm when the pillow is in the open position or may be folded back on itself to expose the well when the pillow is in the open position.

6. A pillow as in claim 5, wherein the cover forms a top surface when the cover extends over the well and the pillow is placed in the closed position.

7. A pillow as in claim 6, wherein the cover includes at least one pocket, and further comprising a pocket fastener to hold the pocket closed.

8. A pillow as in claim 3, further comprising a pouch coupled to the medial region of the pillow body, wherein the pouch is adapted to hold one of the transition regions when the pillow is in the open position.

9. A pillow as in claim 3, further comprising a fastener coupled to each transition region to permit the pillow to be coupled to a stroller.

10. A method for configuring a pillow, the method comprising:

providing a pillow comprising a pillow body comprising a medial region and two curved arms that extend from the medial region, wherein the pillow body has a curved exterior periphery, an interior periphery, a first flap portion extending from the exterior periphery of a first one of the curved arms, a second flap portion extending from the exterior periphery of a second one of the curved arms, and a fastening mechanism;

placing the pillow in an open position where the inner periphery forms a well;

folding the pillow body in half to place the pillow in a closed position where the first and the second arms are generally adjacent each other; and fastening the first and the second flap portions to each other using the fastening mechanism when the pillow body is in the closed position;

wherein a shoulder strap is operably coupled to the pillow body at the ends of the two arms and at the medial region, and further comprising placing the shoulder strap over a user's shoulder to carry the pillow.

11. A method as in claim 10, wherein the flaps each contain a transition region extending from the pillow body, and a shoulder strap coupled to one of the transition regions, and further comprising coupling a free end of the shoulder strap to the other transition region using a fastener.

12. A method as in claim 10, wherein a cover is coupled to one of the arms, and further comprising extending the cover over the well and coupling the cover to the other arm when the pillow is in the open position.

13. A method as in claim 12, further comprising placing the pillow body on a surface such that the cover contacts the surface, and placing a baby within the well and on the cover.

14. A method as in claim 12, further comprising folding the cover back on itself to fully expose the well when the pillow is in the open position.

15. A method as in claim 14, further comprising placing the pillow about the waist of a user and resting a baby on the medial region with the medial region being adjacent the user's stomach and the two arms adjacent the user's sides.

16. A method as in claim 12, wherein the cover includes at least one pocket, and further comprising opening the pocket and placing an object into the pocket when the pillow is in the closed position.

17. A method as in claim 10, wherein the pillow includes a pouch coupled to the medial region of the pillow body, and further comprising placing one of the transition regions in the pouch when the pillow is in the open position.

18. A method as in claim 10, wherein a fastener is coupled to the pillow body, and further comprising coupling the pillow to a stroller using the fastener.

19. A method as in claim 10, further comprising folding down the flaps after opening the pillow to the open position.

20. An infant feeding and support pillow, comprising:

a pillow body comprising a medial region and two curved arms that extend from the medial region, wherein the pillow body has a curved exterior periphery and an interior periphery that defines a well when the pillow is in an open position;

a first flap portion extending from the exterior periphery of a first one of the curved arms and a second flap portion extending from the exterior periphery of a second one of the curved arms;

a fastening mechanism that is configured to couple the first and the second flap portions to each other when the pillow body is folded in half to place the pillow in a closed position, with the first and the second arms being generally adjacent to each other;

a cover coupled to one of the arms, wherein the cover is extendable over the well and may be coupled to the other arm when the pillow is in the open position or may be folded back on itself to expose the well when the pillow is in the open position; and wherein when the cover is folded back on itself, the well region is open such that the pillow may be placed around a user's waist, with the medial region being adjacent the user's stomach and the arms being adjacent the user's sides.

21. An infant feeding and support pillow, comprising:

a pillow body comprising a medial region and two curved arms that extend from the medial region, wherein the pillow body has a curved exterior periphery and an interior periphery that defines a well when the pillow is in an open position;

a first flap portion extending from the exterior periphery of a first one of the curved arms and a second flap portion extending from the exterior periphery of a second one of the curved arms;

a fastening mechanism that is configured to couple the first and the second flap portions to each other when the pillow body is folded in half to place the pillow in a closed position, with the first and the second arms being generally adjacent to each other; and wherein the pillow body has a bottom end at ends of the two arms and a top end at a peak of the medial region, and further comprising a shoulder strap having two ends that are operably coupled to the pillow, with one end of the shoulder strap being operably coupled at the bottom end of the pillow body and the other end of the shoulder strap being operably coupled at the top end of the pillow body.

22. A pillow as in claim 21, further comprising a transition region extending from the pillow body at the bottom end and at the top end, and wherein the ends of the shoulder strap are coupled to the transition region.

* * * * *